United States Patent [19]

Grooms

[11] Patent Number: 4,821,247

[45] Date of Patent: Apr. 11, 1989

[54] EAR-MOUNTED ALARM CLOCK

[76] Inventor: Reginald M. Grooms, Rte. 6, Box 43, Conway, S.C. 29526

[21] Appl. No.: 649,591

[22] Filed: Sep. 11, 1984

[51] Int. Cl.[4] ..... G04B 21/08

[52] U.S. Cl. ..... 368/63; 368/10

[58] Field of Search ..... 368/63, 72, 73, 285

[56] References Cited

U.S. PATENT DOCUMENTS

| | | | |
|---|---|---|---|
| 3,998,045 | 12/1976 | Lester | 368/63 |
| 4,444,515 | 4/1984 | Clark | 368/156 |
| 4,449,232 | 5/1984 | Hashimoto et al. | 368/63 |
| 4,525,076 | 6/1985 | Takebe | 368/63 |

*Primary Examiner*—Bernard Roskoski

*Attorney, Agent, or Firm*—Lathrop & Clark

[57] ABSTRACT

A personal alarm clock is designed to fit within or behind the ear for alerting the user to a preset time without disturbing others in close proximity.

7 Claims, 2 Drawing Sheets

EAR-MOUNTED ALARM CLOCK

BACKGROUND OF THE INVENTION

1. Field of the Invention

This invention relates to an alarm clock, and particularly to a personal alarm clock designed to be mounted in the user's ear.

2. Description of Prior Art

There are many devices known which qualify as alarm clocks. The prior art is filled with manual, electrical, battery, solar, gravitational, etc. driven alarm devices intended to annunciate a certain time of the day. However, heretofore, personal alarms, which are directed to alerting the user without disturbing anyone in close proximity are virtually unknown.

U.S. Pat. No. 1,366,983 discloses an alarm clock having a hammer-bell arrangement. The bell is replaced with a diaphragm, which is covered by a cowling attached to a tube. At the other end of the tube are attached ear pieces adapted to be inserted into the user's ear. According to this reference, at a preset time, the hammer strikes the diaphragm causing a sound capable of awaking the user without disturbing anyone else in close proximity.

As yet, the prior art does not disclose a personal alarm clock which is designed to comfortably and conveniently alert the user to a preset time without disturbing others nearby.

It is accordingly an object of this invention to provide a new and improved alarm clock.

Further, it is an object of this invention to provide a body-mounted, personal alarm clock which will the alert the user to a preset time without disturbing others nearby.

More specifically, it is an object of this invention to provide an ear mounted or in-the-ear alarm device which will alert the user to a preset time without disturbing others.

SUMMARY OF THE INVENTION

These objects and others are accomplished by the invention disclosed herein which is directed to a body-mounted alarm device adapted to alert a user to a preset time. The device comprises an earpiece assembly adapted to be attached to the user for delivering an alarm sound responsive to the preset time. In a preferred embodiment, the invention also comprises a clock connected to the earpiece, which clock comprises an alarm means responsive to a signal from the clock for sounding an alarm.

DESCRIPTION OF THE PREFERRED EMBODIMENTS

Figure 1:
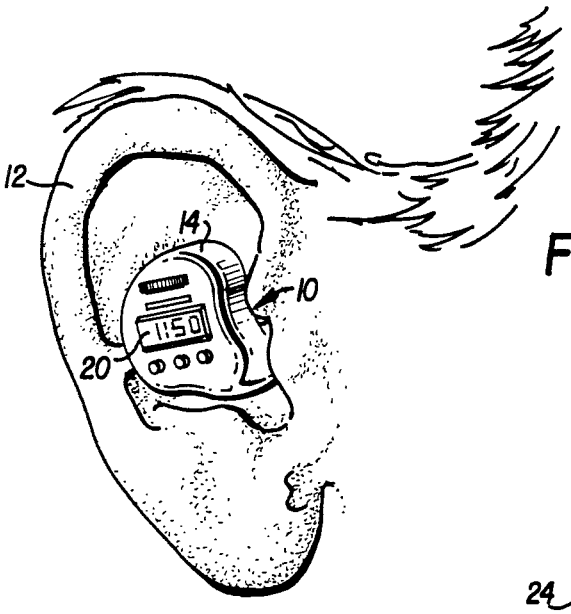
FIG. 1 is a front view showing an in-the-ear alarm device inserted in the ear of a wearer.
Figure 2:
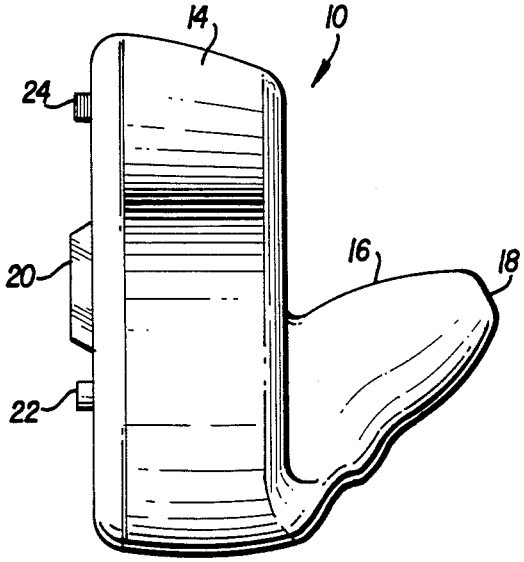
FIG. 2 is a side view of the in-the-ear alarm device of FIG. 1.

The present invention provides a personal sentry system or alarm clock wherein the user may be alerted to a preset time by an alarm perceptible only to the user. Advantageously, the user may be alerted by this "silent" alarm clock without alerting a neighbor, or may be awakened from sleep without disturbing a bed mate.

Referring now to FIGS. 1–4, there is shown a preferred embodiment of this invention. In this embodiment, the alarm device is shown at 10. The alarm device 10 is constructed to fit within outer ear 12 of the wearer much like that of a conventional in-the-ear hearing aid device. The alarm device 10 comprises two basic components: (1) the alarm clock housing 14 and (2) an ear tip portion 16, which can be adapted to project through the concha of the ear and into the auditory canal portion. The alarm clock housing 14 is conventionally constructed of a hard plastic or rubber molded case enclosed, on at least the surface portions in contact with the ear, in a soft vinyl or foam casing. The attached ear tip 16 is suitably formed from a soft material, such as vinyl, silicone plastic or foam, which is deformable to assume the shape of the ear canal. In one embodiment, the alarm clock housing 14 may be attached to a custom ear mold tip 16 for a particular user's ear. In another preferred embodiment, the alarm clock housing 14 may be attached to one of several variations of a soft, flexible universal-type ear tip 16a such as that depicted in FIG. 4. A conventional universal ear tip often provides an excellent fit without the necessity of custom molding.

Ear tip 16 is preferably provided with an aperture 18 for delivery of the alarm to the auditory canal. It is to be understood that the ear tip portion does not have to be inserted within the concha of the ear as long as there is provided suitable means for attaching the alarm device to the ear and for conveying the alarm sound.

Figure 3:
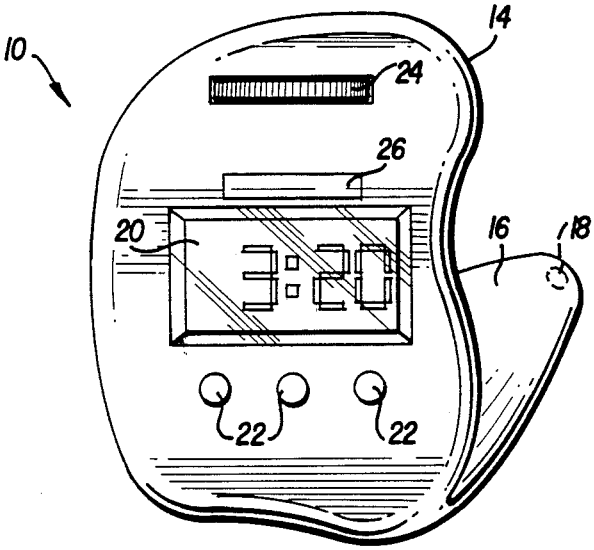
FIG. 3 is a front view of the alarm device shown in FIGS. 1 and 2.
Figure 4:
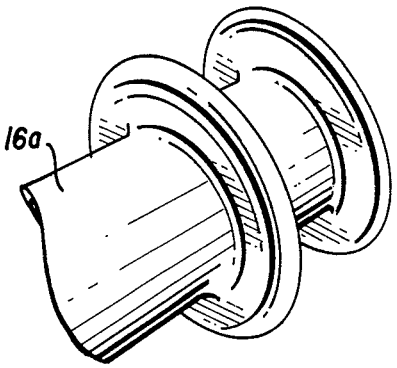
FIG. 4 is a perspective view showing another embodiment of an earpiece design for the alarm device of FIGS. 2 and 3.

The alarm clock within housing 14 may be any conventional type of timepiece which can fit within a housing designed to fit an outer human ear. For convenience of weight and size, however, it is preferred to incorporate a digital watch having a quartz element for generating a repetitive time standard signal which defines the passage of time and a time amending or correction signal. Typical of such timepieces are those found in U.S. Pat. No. 4,115,993, which is referred to for design and operation of the timepiece. Referring now to FIG. 3, the alarm clock generally has a battery-driven electronic circuitry with a display 20 and function setting controls 22 encased in the molded plastic or rubber casing 14 and attached to an ear tip 16. In one embodiment, housing 14 may be a modular unit designed to be detachably mounted to ear tip 16. In this manner, should the alarm clock portion of ear sentry 10 need to be repaired or replaced, it can be conveniently detached from ear tip 16. The alarm clock modular housing 14 may be attached to ear tip 16 in a variety of ways, such as by snap-fitting a male socket portion into a female recessed portion, or by screw mountings.

Of necessity, the alarm sound need not be loud and piercing due to the close proximity between the alarm mechanism and the user's ear. The alarm may conveniently be any time-activated sound or vibration which is strong enough to alert the user to a preset time. In this manner, alarm device 10 may also be provided with a volumetric control device 24 for adjusting the volume of the alarm. The alarm sounding device should be placed in close proximity with ear tip 16 and aperture 18 in order to direct the alerting sound to the user.

For convenience sake, a lamp, designated at 26 may be located within housing 14. Lamp 26 is lighted by pushing one of the function setting controls 22.

Figure 5:
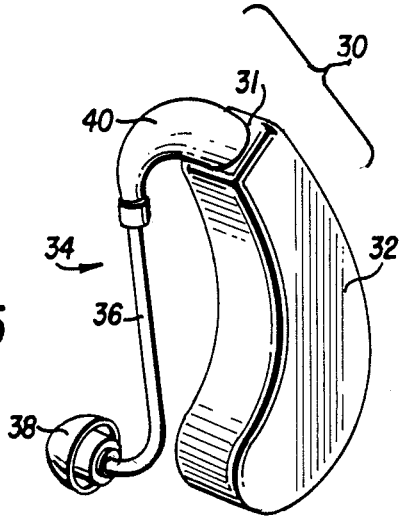
FIG. 5 is a front perspective view of another embodiment showing a behind-the-ear type alarm device.
Figure 6:
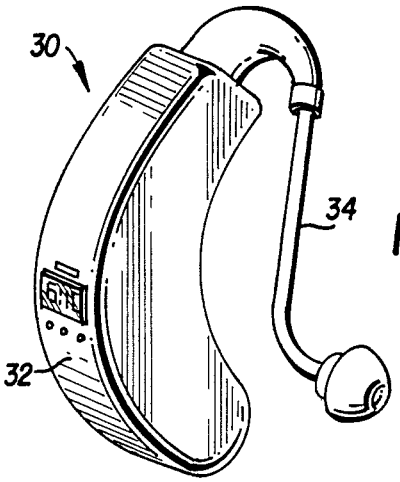
FIG. 6 is a back perspective view of the embodiment of FIG. 5.

Referring now to FIGS. 5 and 6, there is shown another embodiment of the ear mounted alarm device of FIGS. 1–4. Shown in FIGS. 5 and 6 is behind-the-ear alarm device 30 which resembles a behind-the-ear hearing aid. The illustrated arrangement comprises a main body 32 having a generally rectangular cross section and being somewhat curved to follow the contour of the user's ear, and a hooked portion 34 extending from the front end 31 of main body 32. Main body 32 includes an alarm clock, which has been substantially described with respect to FIGS. 1–4. The hooked portion 34 comprises a flexible plastic tube 36 which is used as a sound passageway extending from main body 32 to the distillate end or ear tip 38.

The hooked portion 34 has a shape suitable for hanging the main body 32 on the upper portion of the ear lobe of the user with the inside or lefthand side (as viewed in FIG. 5) of the main body 32 substantially engaged by the outer root of the ear lobe. The alarm clock housed within main body 32 may have the same types of controls as the clock described with reference to FIG. 1–4.

A third embodiment, not shown, is similar to either of the two previous embodiments with the exception that the ear device is a remote control receiver for a detached clock. In this manner, the user has the option of relying upon a standard desk top alarm clock equipped with a sensing device for relaying a signal to a remote alarm inserted within the ear sensing device worn by the user. In this manner, the user may set an alarm with the desk alarm clock and at a preset time and receive a signal activating the alarm within the ear sentry device. Thus, the user has the option of using a standard alarm clock or a private, ear sentry device.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of appended claims.

I claim:

1. An ear mounted alarm device adapted to alert a user to a preset time, said device comprising:

(1) an earpiece adapted to fit within said user's outer ear for delivering a personal alarm sound perceptible only to said user, said alarm sound being responsive to said preset time, said earpiece having a distal and proximal end, said distal and proximal ends having apertures communicating with each other for delivery of said alarm sound to the auditory canal of said user; and (2) a clock connected to said earpiece, said clock comprising an alarm sounding means situated in close proximity with said proximal end of said earpiece, said alarm sounding means being responsive to a signal from said clock for sounding said alarm sound;

wherein said alarm sounding means directs said alarm sound toward said distal end of said earpiece.

2. The device according to claim 1, in which said clock and said earpiece are intimately connected together and adapted to fit within the ear.

3. The device according to claim 1, in which said clock and said earpiece are connected such that said clock is adapted to be mounted behind the ear and said earpiece is adapted to be mounted within the ear.

4. The device according to claim 1, in which said clock is detachably connected to said earpiece.

5. The device according to claim 1, in which said clock is connected to said earpiece by means of signal waves.

6. The device according to claim 1, in which said earpiece comprises a custom fit ear tip.

7. The device according to claim 1, in which said earpiece comprises a universal ear tip.

* * * * *